United States Patent [19]

Hisatsune et al.

[11] 4,420,660

[45] Dec. 13, 1983

[54] CIRCUIT BREAKER

[75] Inventors: Fumiyuki Hisatsune; Shinji Yamagata; Junichi Terachi, all of Fukuyama; Hajimu Yoshiyasu, Itami, all of Japan

[73] Assignee: Mitsubishi Denki Kabushiki Kaisha, Tokyo, Japan

[21] Appl. No.: 350,174

[22] Filed: Feb. 19, 1982

[30] Foreign Application Priority Data

Feb. 26, 1981 [JP] Japan ..... 56-27927
Feb. 27, 1981 [JP] Japan ..... 56-29660

[51] Int. Cl.[3] ..... H01H 9/30
[52] U.S. Cl. ..... 200/144 R; 335/201
[58] Field of Search ..... 335/201; 200/144 R

[56] References Cited

U.S. PATENT DOCUMENTS 3,402,273 9/1968 Davis ..... 200/144 R

FOREIGN PATENT DOCUMENTS 1765051 7/1971 Fed. Rep. of Germany ... 200/144 R

*Primary Examiner*—Harold Broome
*Attorney, Agent, or Firm*—Wenderoth, Lind & Ponack

[57] ABSTRACT

The present invention provides a circuit breaker of improved performance by providing arc shields and arc runways together with the contacts on the rigid conductors of the contactors of a circuit breaker, and disposing said arc runways on the stationary contactor side is a predetermined relationship to the arc extinguishing plates such that a portion of the cut-out in at least one of said arc extinguishing plates substantially overlaps said arc runway.

4 Claims, 16 Drawing Figures

CIRCUIT BREAKER

BACKGROUND OF THE INVENTION

This invention relates to a circuit breaker, and in particular to a novel circuit breaker constructed so as to be able to efficiently cool an arc drawn between the contacts when breaking a fault current.

In prior-art circuit breakers, there was the drawback that the foot of the arc drawn between the contacts spread to the rigid conductor of the contactor, on which the contact was mounted, so that it was not possible to cool the arc efficiently. Further, in prior-art circuit breakers there was inadequate contact between the arc and the arc extinguishing plates such that the effects of arc cooling and extinguishing effect of the arc extinguishing plates were not sufficient.

SUMMARY OF THE INVENTION

It is an object of this invention to provide on each of the stationary and movable contactor conductors of a circuit breaker a contact together with an arc shield and an arc runway, one end portion of the arc runway on the stationary rigid conductor of the stationary contactor being disposed such that it is overlapped by at least one of a plurality of plates of an arc extinguishing plate assembly as viewed in overhead plan view, whereby the foot of the arc is prevented from expanding by the arc shield, and the transfer of the arc by means of the arc runway, and cooling and extinguishing of the arc by the arc extinguishing plate assembly are effectively carried out.

It is a further object of this invention to specify the position at which the aforementioned arc runway on the stationary contactor and the at least one arc extinguishing plate overlap when viewed in overhead plan view, thereby to ensure positively that the arc will contact the arc extinguishing plates, whereby the efficiency of the cooling and the extinguishing of the arc is increased.

BRIEF DESCRIPTION OF THE DRAWINGS

FIG. 1(*b*) is a side sectional view along the line b—b of the circuit breaker of FIG. 1(*a*);

FIG. 2(*b*) is a plan view of the main parts of the stationary contactor of FIG. 2(*a*);

FIG. 2(*c*) is a front view of the stationary contactor of FIG. 2(*a*);

FIG. 4(*b*) is a side sectional view of the circuit breaker of FIG. 4(*a*), taken along the line b—b;

FIG. 5(*b*) is a side view of the main parts of the stationary contactor of FIG. 5(*a*);

FIG. 6(*b*) is a perspective view of the movable contactor shown in FIG. 6(*a*) seen from the opposite side to FIG. 6(*a*);

FIG. 9(*b*) is a side sectional view of the circuit breaker of FIG. 9(*a*) taken along the line b—b.

In the figures, like reference numerals denote like or corresponding parts.

DESCRIPTION OF THE PREFERRED EMBODIMENTS

A description will now be given of a conventional circuit breaker to which this invention is applicable, with reference to FIGS. 1(*a*) and (*b*).

Figure 2A:
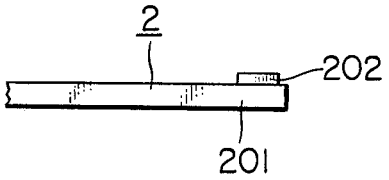
FIG. 2(*a*) is a side view of the main parts of the stationary contactor provided in the circuit breaker of FIG. 1(*a*)
Figure 2B:
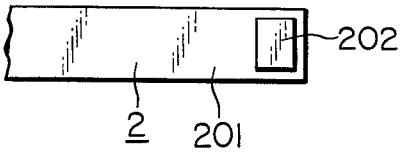
Figure 2C:
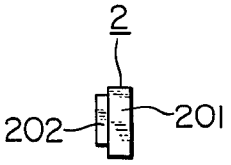
Figure 3:
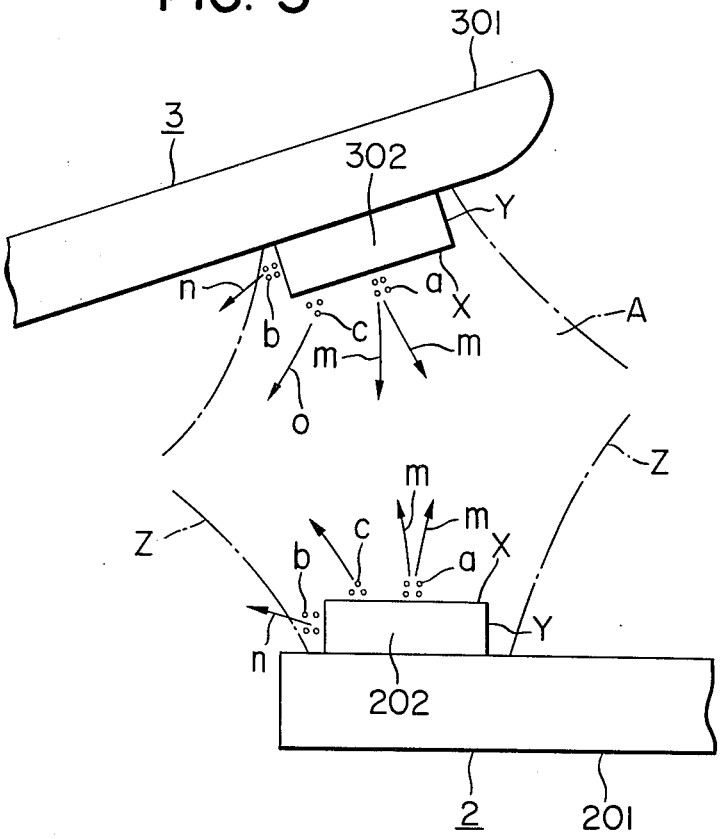
FIG. 3 is a diagram showing the behaviour of the arc drawn across the contacts of the circuit breaker of FIG. 1(*a*)

An enclosure 1 made of insulating material forms the housing for a circuit breaker, which comprises a pair of electrical contactors 2 and 3, which are respectively a stationary contactor and movable contactor. On the electrical contacting surface of a stationary rigid conductor 201, which forms the main part of the stationary contactor 2, is affixed a stationary-side contact 202, as shown in FIGS. 2(*a*) to (*c*), and on the electrical contacting surface of a movable rigid conductor 301, which forms the main part of the movable contactor 3, is affixed a movable-side contact 302, as shown in FIG. 3. An operating mechanism 4 operates to open or close the circuit breaker by moving the movable contactor 3 in or out of contact with the stationary contactor 2. An arc-extinguishing plate assembly 5 comprising a plurality of arc extinguishing plates 501 supported by frame plates 502 cools an electric arc A struck across the stationary-side contact 202 and the movable side contact 302. The operating mechanism 4 and the arc-extinguishing plate assembly 5 are well known in the art, and are described, for example, in U.S. Pat. No. 3,599,130, "Circuit Interruptor," issued to W. Murai et al., Aug. 10, 1971. As apparent from the named patent, the operating mechanism includes a reset mechanism. An exhaust port 101 is formed in the enclosure 1.

Figure 1A:
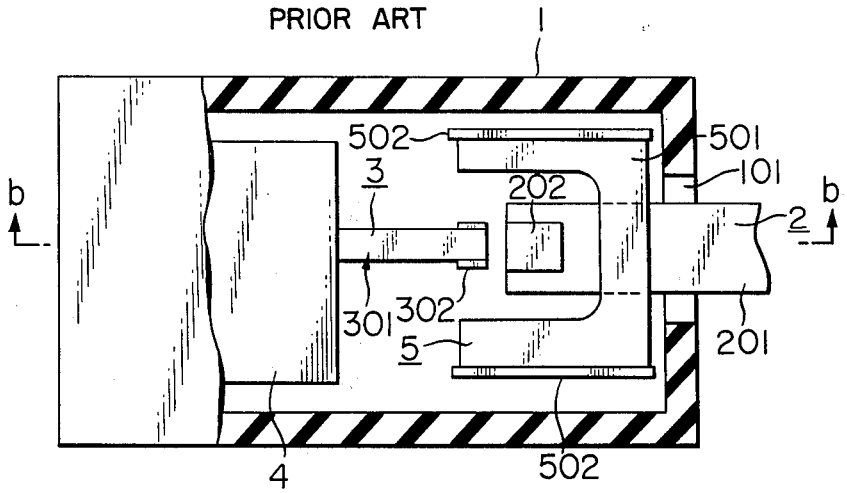
FIG. 1(a) PRIOR ART
FIG. 1(*a*) is a sectional plan view of a circuit breaker to which the present invention can be applied.
Figure 1B:
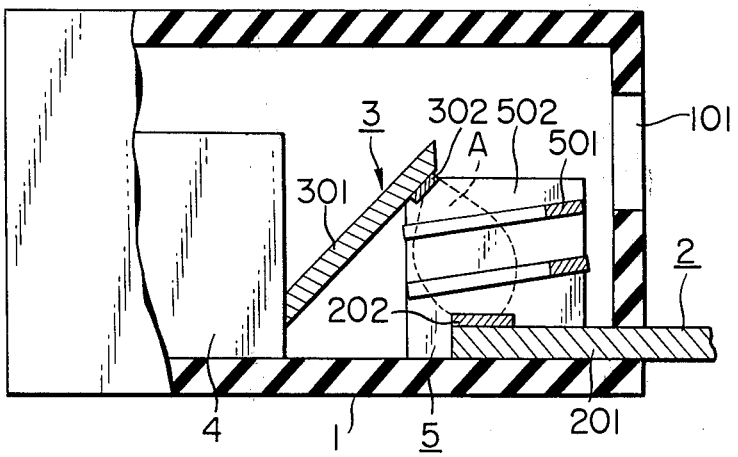
FIG. 1(b) PRIOR ART

In FIGS. 1(*a*) and (*b*), when the movable-side contact 302 and the stationary side contact 202 are in contact, current flows from a power supply side to a load side along a path from the stationary rigid conductor 201 to the stationary-side contact 202 to the movable-side contact 302 to the movable rigid contactor 301. When, in this state, an over-current such as a short-circuit current flows through the circuit, the operating mechanism 4 operates to separate the movable-side contact 302 from the stationary-side contact 202. At this time, an arc A appears across the gap between the stationary-side contact 202 and the movable-side contact 302, and an arc voltage develops thereacross. The arc voltage rises as the distance between the movable-side contact 302 and the stationary-side contact 202 increases. In addition, at the same time, the arc A is drawn by the magnetic force of attraction in the direction of the arc-extinguishing plate assembly 5, and the arc-extinguishing plates cause the arc to be stretched, thus further raising the arc voltage. In this way, the arc current reaches the current zero point, the arc A is extinguished, and the interruption is completed.

During the interrupting operation thus far described, large quantities of energy are generated across the gap between the movable-side contact 302 and the stationary-side contact 202 in a short space of time on the order of several milliseconds, by the arc A. In consequence, the temperature of the gas within the enclosure 1 rises abruptly, as does the pressure thereof, and the high temperature and pressure gas is emitted into the atmosphere through the exhaust port 101.

The circuit breaker performs the interrupting operation as described above to interrupt overcurrents. The performance required of a circuit breaker that operates in this way is that the arc voltage be high, whereby the arc current flowing during interruption is suppressed, reducing the magnitude of the current that flows through the circuit breaker. Accordingly, a circuit breaker which generates a high arc voltage, exhibits excellent protection performance with regard to all serially connected electrical equipment, including the wiring. Heretofore, in circuit breakers of this type, in order to establish a high arc voltage, the movable conductor 301 was caused to separate at high speed, or the arc A was caused to stretch, using magnetic force, but in these cases there was found to be a certain limit to the rise in arc voltage, and satisfactory results were not obtained.

An explanation will now be given with regard to the behaviour of the arc voltage, etc., across the stationary-side and movable-side contacts 202 and 302 of the circuit breaker shown in FIGS. 1(*a*) and (*b*).

In general, the arc resistance R (Ω) is given by the following expression:

$$R=\rho(l/S)$$

where $\rho$: arc resistivity (Ω·cm)

l: arc length (cm) S: arc sectional area ($cm^2$)

In general, in a short arc A with a high current of at least several kA and an arc length l of at most 50 mm, the arc space is occupied by metal particles from the contacts. The emission of metal particles from the rigid conductors occurs orthogonally to the contact surfaces, and at the time of the emission, the emitted particles have a temperature close to the boiling point of the contact metal. Further, when they are injected into the arc space, they are injected with electrical energy, rising in temperature and pressure, and taking on conductivity, and they flow out of the arc space at high speed in a direction away from the conductors while expanding in a direction according to the pressure distribution in the arc space. Thus, the arc resistivity $\rho$ and the arc sectional area S in the arc space are determined by the quantity of contact particles produced and the direction of emission thereof. Accordingly, the arc voltage is also determined by the behaviour of such contact particles.

The behaviour of such electrode particles is explained in conjunction with FIG. 3. In FIG. 3, the stationary contactor 2 and a movable contactor 3 form the mutually confronting pair of contactors in which the movable contactor 3 moves in or out of contact with the stationary contactor 2 to make or break an electric circuit. The surfaces X of the respective contactors 2 and 3 are opposing surfaces which become contact surfaces when the contactors 2 and 3 make contact, and the surfaces Y of the respective contactors 2 and 3 are the surfaces of the contactors other than the surfaces X, the respective opposing contact surfaces. A contour Z indicated by the dot-and-dash line in the figure shows the envelope of the arc A struck across the contactors 2 and 3. Further the contact particles emitted from the contactors 2 and 3 are shown in model form by a, b and c, wherein a represents the contact particles emitted from the vicinity of the center of the opposing surfaces X, b represents particles emitted from the surfaces Y, the other surfaces of the contacts and the rigid conductors 201 and 301, and c represents the contact particles emitted from the peripheral portion of the opposing surfaces X, at a position between the areas of origin of the particles a and b. The paths of the particles a, b and c after emission respectively are along the flow lines shown by the arrows M, N and O.

Such contact particles a, b and c emitted from the contactors 2 and 3 have their temperature raised from approximately 3,000° C., the boiling point of the metal of the contactors, to a temperature at which the metal particles take on conductivity, i.e., at least 8,000° C., or to an even higher temperature of approximately 20,000° C., and so energy is taken out of the arc space and the temperature of the arc space is lowered, the result of which is to produce arc resistance. The quantity of energy taken from the arc space by the particles a, b and c increases with the rise in the temperature, and the degree of rise in temperature is determined by the positions and emission paths in the arc space of the electrode particles a, b and c emitted from the contactors 2 and 3. However, in FIG. 3, the particles a emitted from the vicinity of the center of the opposing surfaces X take a large quantity of energy from the arc space, but the particles b emitted from the surfaces Y on the contacts and rigid conductors, compared to the particles a, take little energy from the arc space, and further the particles c emitted from the peripheral portion of the opposing surfaces X take out only an intermediate amount of energy approximately midway between the amounts of energy taken by the particles a and b.

That is to say, within the range in which the particles a flow, it is possible to take out large quantities of energy and to lower the temperature of the arc space, and hence to increase the arc resistivity $\rho$, but within the range in which the particles b and c flow, large quantities of energy are not taken out, and so the lowering of the temperature in the arc space as a result thereof is small, and so an increase in the arc resistivity $\rho$ cannot be achieved. Moreover, since the arc is produced from the opposing surfaces X and the contactor surfaces Y, the arc's cross-sectional area increases, and the arc resistance is consequently lowered.

This energy outflow from the arc space due to the contact particles is proportional to the electrically injected energy, and so if the quantity of particles a produced between the contacts 202 and 302 and injected into the arc space were increased, the temperature in the arc space would, of course, be greatly lowered, with the result that the arc resistivity could be increased, and the arc voltage greatly increased.

This invention extends the limits with regard to the increase in arc voltage in prior-art conventional circuit breakers as hereinabove described, and by means of arc shields provided on the electrical contactors it is able to increase the quantity of contact particles produced between the contacts and that are injected into the arc space, and to greatly raise the arc voltage, thereby to improve the current limiting effect of the circuit breaker, and particularly as is to be described below, by providing a certain positional relationship between an arc runway provided adjacent to the contact on the stationary contactor and a cut-out slit in the arc extinguishing plates directly thereabove, it is possible to cause the arc to travel rapidly from the contacts to the arc extinguishing plates, to extinguish the arc effectively. This travelling and extinguishing of the arc make it possible both to raise the interruption performance of the circuit breaker, and to prevent wear of the contacts.

Figure 4A:
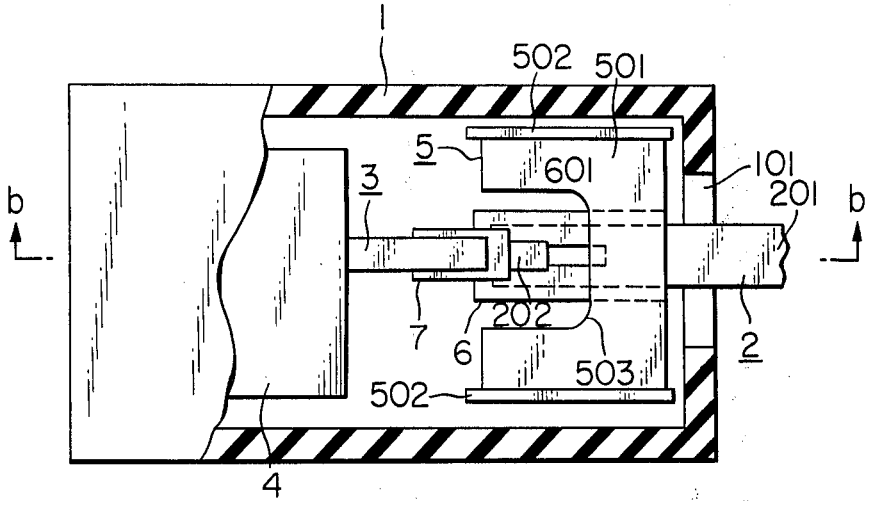
FIG. 4(*a*) is a sectional plan view of a circuit breaker according to this invention.
Figure 4B:
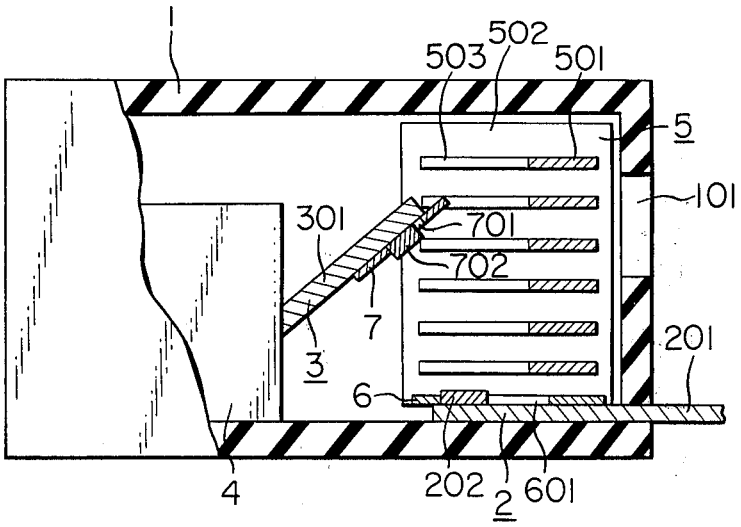
Figure 5A:
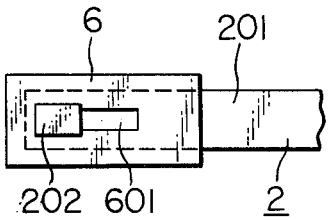
FIG. 5(*a*) is a plan view of the main parts of a stationary contactor provided in the circuit breaker of FIG. 4(*a*)
Figure 5B:
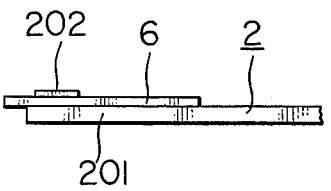
Figure 6A:
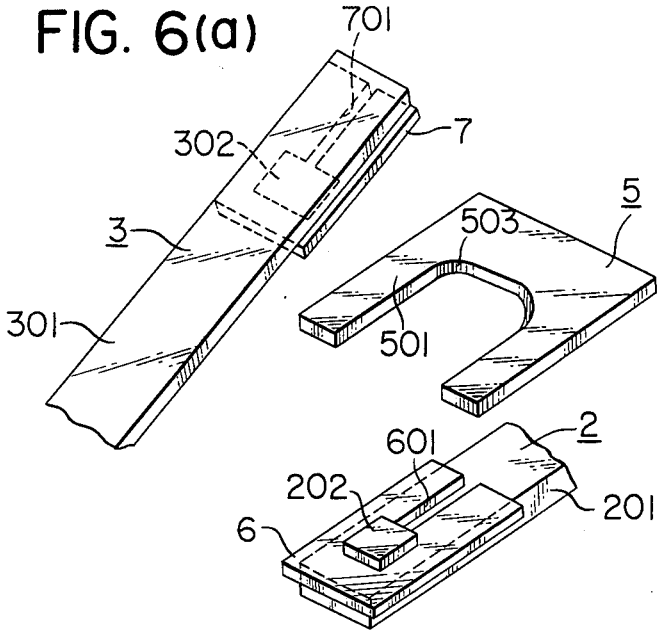
FIG. 6(*a*) is a perspective view of the stationary contactor, the movable contactor and the arc extinguishing plate assembly of the circuit breaker of FIG. 4(*a*)
Figure 6B:
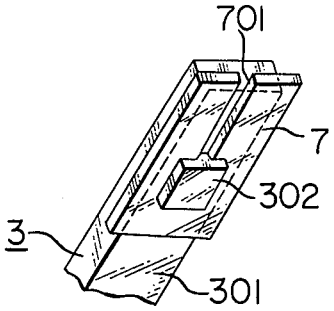

FIGS. 4(*a*) and (*b*) are respectively a sectional plan view and a side sectional view of a circuit breaker illustrating an embodiment of the present invention. FIGS. 5(*a*) and (*b*) are respectively a plan view and a side view of the contact portion of a stationary contactor. FIG. 6(*a*) is a perspective view showing the relationship between the stationary contactor, the movable contactor, and the arc extinguishing plates, and FIG. 6(*b*) is a perspective view of the movable contact portion. In these figures, arc shields 6 and 7 are respectively affixed to the stationary rigid conductor 201 and the movable rigid conductor 301 so as to cover and conceal therebehind the portions of the rigid conductors 201 and 301 other than the contacting surfaces of the respective contacts 202 and 302. Additionally, slits or grooves are provided in the arc shields 6 and 7 extending in the lengthwise direction of the rigid conductors 201 and 301 from the contacts 202 and 302, in the direction toward the arc extinguishing plate assembly 5, the grooves constituting arc runways 601 and 701. In this embodiment, the end portion of the arc runway 601 on the stationary contactor side is positioned such that it lies directly under at least one of the arc extinguishing plates 501, when viewed as in FIG. 4(*a*), in overhead plan view. That is to say the arc runway 601 extends further in the direction from the contact 202 towards the arc extinguishing plate assembly 5 than the notch or cut-out slit 503 in at least one of the arc extinguishing plates 501, extending across the bottom edge of the cut-out slit 503. In practice, it is best to think of the arc extinguishing plate or plates 501 as overlapping the arc runway, or being transected by an imaginary line extending vertically upwards from the periphery of the arc runway 601 as defined by the cut-out portion of the arc shield 6. The material of the arc shields 6 and 7 is a material having a resistivity higher than the resistivity of the material forming the respective rigid conductors 201 and 301, and may, for example, be an organic or inorganic insulator, or a high resistivity metal such as copper-nickel, copper-manganin, manganin, iron-carbon, iron-nickel, or iron-chromium, etc. In this embodiment, the arc shields are in a plate form, but they can be formed to cover the rigid conductors, particularly on the movable contactor 3 side, whereby the weight can be made low, making the movement of inertia low, thereby making possible a high opening speed. The effects of employing plate shaped arc shields in this embodiment are as stated hereinbelow.

In the instance of a circuit breaker rated at 100 A, the contacts 202 and 302 according to this embodiment would suitably measure substantially 4.5 mm by 4.5 mm, and the arc runways 601 and 701 would suitably be approximately 2 mm in width.

The aforementioned arc runways 601 and 701 are not limited to means for exposing the rigid conductors 201 and 301, for a product formed of a material of a higher conductivity than the arc shields may also be affixed thereto. The arc extinguishing plates 501 may be constructed of a magnetic or a non-magnetic material, but if they are constructed of a non-magnetic material it is possible to eliminate the problem of a temperature rise in the arc extinguishing plates due to eddy currents that occur with magnetic materials. Next the operation of the above construction will be explained.

The overall circuit breaker operation is substantially the same as that of the circuit breaker shown in FIGS. 1(*a*) and (*b*), so that part of the explanation is omitted, but the behaviour of the contact particles between the two contacts differs from that of the device shown in FIGS 1(*a*) and (*b*), and so this is explained hereinbelow in conjunction with FIG. 7.

Figure 7:
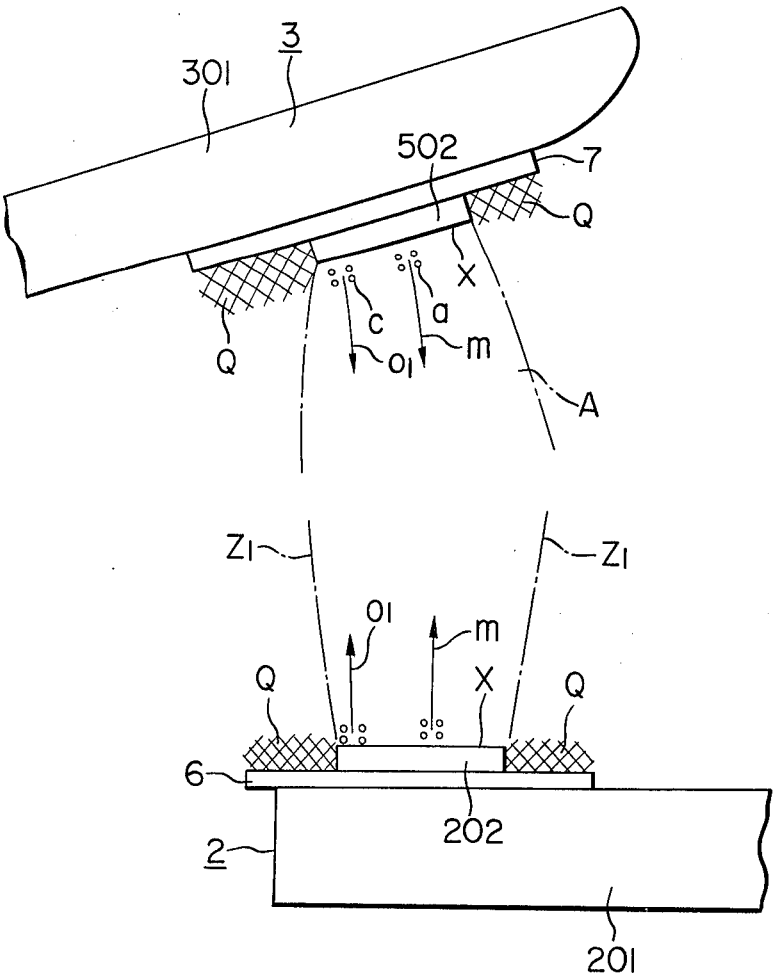
FIG. 7 is a diagram showing the effects of the arc shield provided in the circuit breaker of FIG. 4(*a*)
Figure 8:
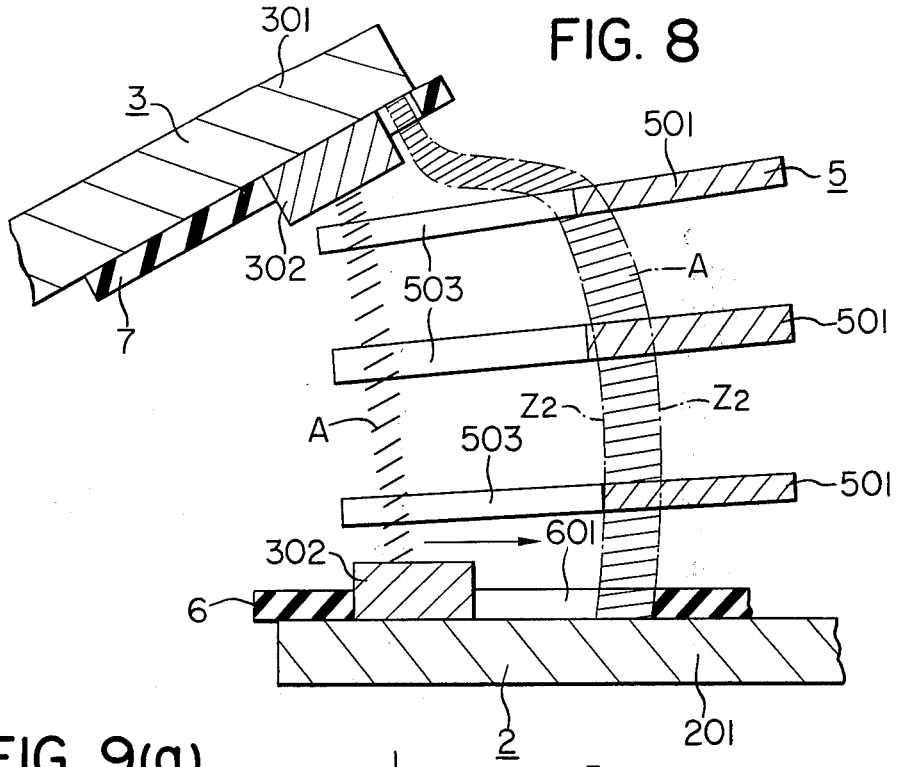
FIG. 8 is a diagram showing the behaviour of the arc drawn between the contacts of the circuit breaker of FIG. 4(*a*)

In FIGS 7 and 8, arc shields 6 and 7 are provided together with the contacts 202 and 302 on the rigid conductors 201 and 301. The arc shields 6 and 7 are in a plate form, and surround the contacts 202 and 302 so as to cover and conceal the rigid conductors therebehind. In the figure, X, a, c and n denote the same as in FIG. 3, and the dot-and-dash line $Z_1$ indicates the envelope of the space of arc A contracted by the circuit breaker of this invention, the dot-and-dash line $Z_2$ (FIG. 8) indicates the envelope of the arc A when the arc spot is shifted in the arc runway 601 and 701. The arrow $o_1$ indicates the flow lines of the contact particles c that in the circuit breaker of this invention flow in a different path from that of the prior-art device, and the intersecting oblique lines Q indicate the space in which the pressure generated by the arc A is reflected by the arc shields 6 and 7, raising the pressure which was lowered in the prior-art device without the arc shields 6 and 7.

The electrode particles between the contacts in the circuit breaker of this invention behave as follows. The pressure values in the space Q cannot exceed the pressure value of the space of the arc A itself, but much higher values are exhibited, at least in comparison with the values attained when the arc shields 6 and 7 are not provided. Accordingly, the relatively high pressure in the space Q produced by the arc shields 6 and 7 acts as a force to suppress the spread of the space of the arc A, and the arc A is confined to a small area. In other words, the flow lines of the contact particles a and c emitted from the opposing surfaces X are narrowed and confined to the arc space. Thus, the contact particles a and c emitted from the opposing surfaces X are effectively injected into the arc space with the result that a large quantity of effectively injected contact particles a and c take a quantity of energy out of the arc space of a magnitude that greatly exceeds that taken out in the prior art circuit breaker, thus markedly cooling the arc space and hence causing a marked increase in the arc resistivity $\rho$, i.e. the arc resistance R, and substantially raising the arc voltage.

Further, the pressure between the contacts 202 and 302 is raised as above described, and so a strong gas flow towards the exhaust port 101 is produced, and the arc spot on the contacts 202 and 302 runs on the arc runways 601 and 701 in the arc shields 6 and 7, as shown by $Z_2$ in FIG. 8. For this reason, wear of the contacts 202 and 302 is radically reduced, and the length of the arc is increased, enabling a remarkable current limiting effect to be achieved. Furthermore, since the arc column positively contacts the bottom edge of the cut-out slit 503 in the arc extinguishing plates 501, and is thus cooled, the heat exchangability of the arc heat is improved, and so, accordingly, is the interruption performance.

Figure 9A:
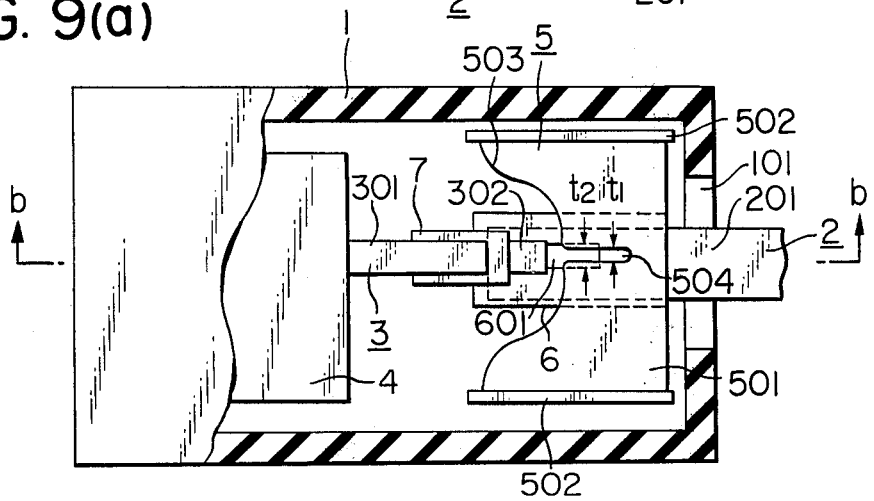
FIG. 9(*a*) is a sectional plan view showing another embodiment of a circuit breaker in accordance with this invention.
Figure 9B:
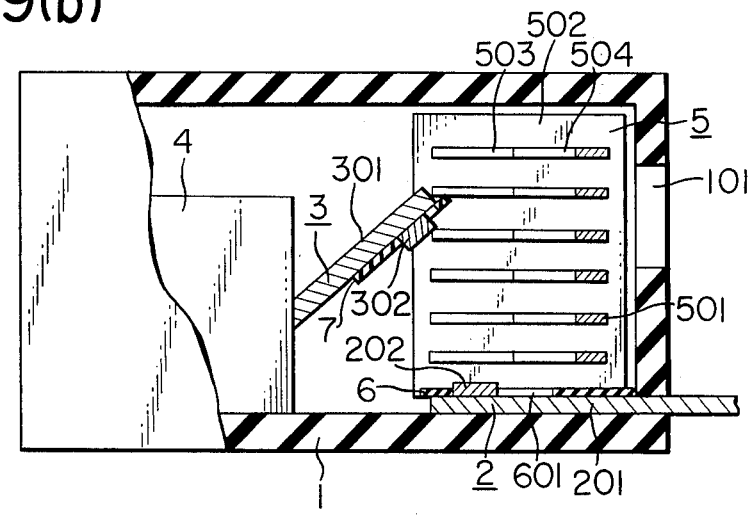

FIGS. 9(*a*) and (*b*) are respectively a sectional plan view and a side sectional view of a circuit breaker according to another embodiment of the present invention. In the arc extinguishing plates 501 in the circuit breaker of this embodiment, an additional slit 504 is provided at the bottom of the cut-out portion 503. Said slit 504 extends parallel to the arc runway 601 on the stationary contactor 2, and its width $t_1$ is the same as the width $t_2$ of the arc runway 601, or is smaller than the same, i.e. the relationship $t_1 \leqq t_2$ exists. When the circuit breaker operates, the arc A drawn across the stationary contact 202 and the movable contact 302 runs along the arc runways 601 and 701 in the direction towards the arc extinguishing plate assembly 5, as shown in FIG. 8. In this instance, the width of the arc positive column comes to be substantially the same as the width $t_2$ of arc runways 601 and 701, because of the arc shields 6 and 7, and so the arc A running in the above-mentioned runways 601 and 701 contacts the arc extinguishing plates 501 with the slits 504 of width $t_1$, which is the same as or smaller than the abovementioned width $t_2$, during the run in the runways 601 and 701, and the arc A is thus cooled and extinguished. If the width $t_1$ of the slits 504 at the bottom of the above-mentioned cut-outs 503 were larger than the width $t_2$ of the arc runway 601, the arc A would contact the arc extinguishing plates 501 at the end of the slits 504, thus extinguishing the arc, but by making the slits 504 narrower than the width $t_2$ of the arc runway 601, as in this embodiment, cooling is effected while the arc A is still running, thus aiding the arc extinguishing effect of the arc extinguishing plates 501.

What is claimed is:

1. A circuit breaker comprising:

a pair of contactors each of which has a conductor and a contact secured thereto, said contacts abutting each other when said conductors are close to each other, one of said contactors being fixed and the other being movable away from and toward said one contactor to open and close an electric circuit, arc shields of a material having a resistivity greater than the material of said conductors and said contacts, one positioned on each of said contactors surrounding the periphery of said contacts, for narrowing the arc generated between said contacts when said contacts separate, at least said shield on said fixed contactor having an arc running groove therein, one end of which is adjacent to the contact therewithin and which has a width no greater than that of said contact, and extending away from said contact in a direction in which the arc formed between said contacts runs when said contacts separate, and an arc extinguishing plate assembly having a row of a plurality of arc extinguishing plates for extinguishing an arc produced between said contacts when said contacts separate, said plate assembly being positioned adjacent the other end of said arc running groove in said fixed contactor and the other end of said arc running groove extending to a position at which the edges of the plates in said arc extinguishing plate assembly which are toward said contacts overlie the other end of said arc running groove.

2. A circuit breaker according to claim 1, wherein said arc extinguishing plates each having a notch in the edge toward said contacts and said arc running groove has the center line thereof passing through the center of said notch and extending past the bottom of said notch.

3. A circuit breaker according to claim 2, wherein the width of said arc running groove in the direction perpendicular to the direction in which said arc running groove extends is smaller than the corresponding dimension of said notch.

4. A circuit beaker according to claim 2 in which said arc extinguishing plates each further have a slit therein in the bottom of the notch and extending away from the contacts, said slit being narrower than said arc running groove, and the end of said slit remote from said contacts extending past the end of said arc running groove.

* * * * *